US006450440B2

(12) United States Patent
Compagnucci

(10) Patent No.: US 6,450,440 B2
(45) Date of Patent: Sep. 17, 2002

(54) YARN-WINDING REEL COMPOSED OF AN ANNULAR SERIES OF BENT ROD IRON MODULAR ELEMENTS

(75) Inventor: Rossano Compagnucci, Santa Maria Nuova (IT)

(73) Assignee: Compagnucci - S.p.A. (IT)

( * ) Notice: Subject to any disclaimer, the term of this patent is extended or adjusted under 35 U.S.C. 154(b) by 0 days.

(21) Appl. No.: 09/730,613

(22) Filed: Dec. 6, 2000

(30) Foreign Application Priority Data

Dec. 7, 1999 (IT) ..... MC990043 U

(51) Int. Cl.[7] ..... B65H 75/20
(52) U.S. Cl. ..... 242/604.1; 242/608.8
(58) Field of Search ..... 242/604.1, 608.8, 242/118.1

(56) References Cited

U.S. PATENT DOCUMENTS 1,396,450 A * 11/1921 Martin ..... 242/604.1
4,089,485 A * 5/1978 Van de Loock ..... 242/608.8
5,476,235 A * 12/1995 Di Gioia et al. ..... 242/604.1
5,494,238 A * 2/1996 DiGioia et al. ..... 242/604.1
5,823,465 A * 10/1998 Marangoni ..... 242/604.1

FOREIGN PATENT DOCUMENTS

EP 0 064 894 A1 * 11/1982 ..... 242/118.1 X

* cited by examiner

*Primary Examiner*—Michael R. Mansen
*Assistant Examiner*—Minh-Chau Pham
(74) *Attorney, Agent, or Firm*—Robert M. Gamson; Leonard Bloom

(57) ABSTRACT

The present invention relates to a reel for winding yarn. The reel is formed from a plurality of identical modular elements. Each modular element is a single rod having a plurality of bends. The modular elements are disposed in a series of adjacent elements which are welded to one another at two points between each adjacent element.

3 Claims, 3 Drawing Sheets

YARN-WINDING REEL COMPOSED OF AN ANNULAR SERIES OF BENT ROD IRON MODULAR ELEMENTS

BACKGROUND OF THE INVENTION

The present patent application for industrial invention relates to a yarn-winding reel realized by electrically welding an annular series of pre-bent rod iron modular elements. Once assembled, the modular elements generate two opposite identical circular grids connected by an annular series of transversal bars that form a cylindrical cage used to wind a skein of yarn contained between the two opposite grids.

Once the modular rod iron elements have been welded one after the other, they generate a reel with central hub that can be directly coupled to the shaft of the machines used to automatically wind or unwind skeins of yarn.

The market currently offers two different models of electrically welded rod iron reels, one with hub and one without hub.

The first model is made up of a pair of parallel metal circles, on which some rod iron elements are externally welded. By means of intersection the rod iron elements create a central hub with square cross-section.

The two circles are connected through an annular series of transversal bars, whose ends are welded on the rod iron elements welded on the outside of the circles.

The second model has a simpler, cheaper structure formed by an annular series of pre-bent rod iron modular elements. Once they have been welded, the modular elements generate a pair of parallel rings connected by a radial series of transversal forks used to wind the skein of yarn.

This model, however, requires the use of an adaptation cylinder in order to be applied on the shaft of the machines used to automatically wind or unwind skeins of yarn.

The adaptation cylinder must be inserted in the cylindrical compartment, around which the radial series of transversal forks is arranged.

Although more complex in structure, the first model is easier to use, since the presence of the central hub allows for its direct insertion on the shaft of automatic winding machines.

In other words, the use of the first model of reel (that is the model provided with hub) allows for saving not only on the purchasing cost of adaptation cylinders, but also on the time and labour necessary to couple or uncouple the adaptation cylinder to or from each reel.

Moreover, a considerable amount of time is lost in looking for the adaptation cylinders, since they are usually stocked in warehouses at some distance from the automatic machine on which they are used.

BRIEF SUMMARY OF THE INVENTION

The purpose of the present invention is to realise a new model of electrically welded rod iron reel, which features the advantages of both reel models described above.

More precisely, the convenience of the new model of reel according to the present invention derives from its constructive technique based on the use of an annular series of pre-bent rod iron modular elements capable of being electrically welded one after the other one.

Moreover, the convenience of the new model of reel according to the present invention derives from the fact that the reel is provided with a central hub, obtained through the innovative original shape of the pre-bent modular elements.

BRIEF DESCRIPTION OF THE DRAWINGS

For major clarity the description of the metal reel continues with reference to the enclosed drawings, which are intended for purposes of illustration and not in a limiting sense, whereby.

DETAILED DESCRIPTION OF THE INVENTION

Figure 1:
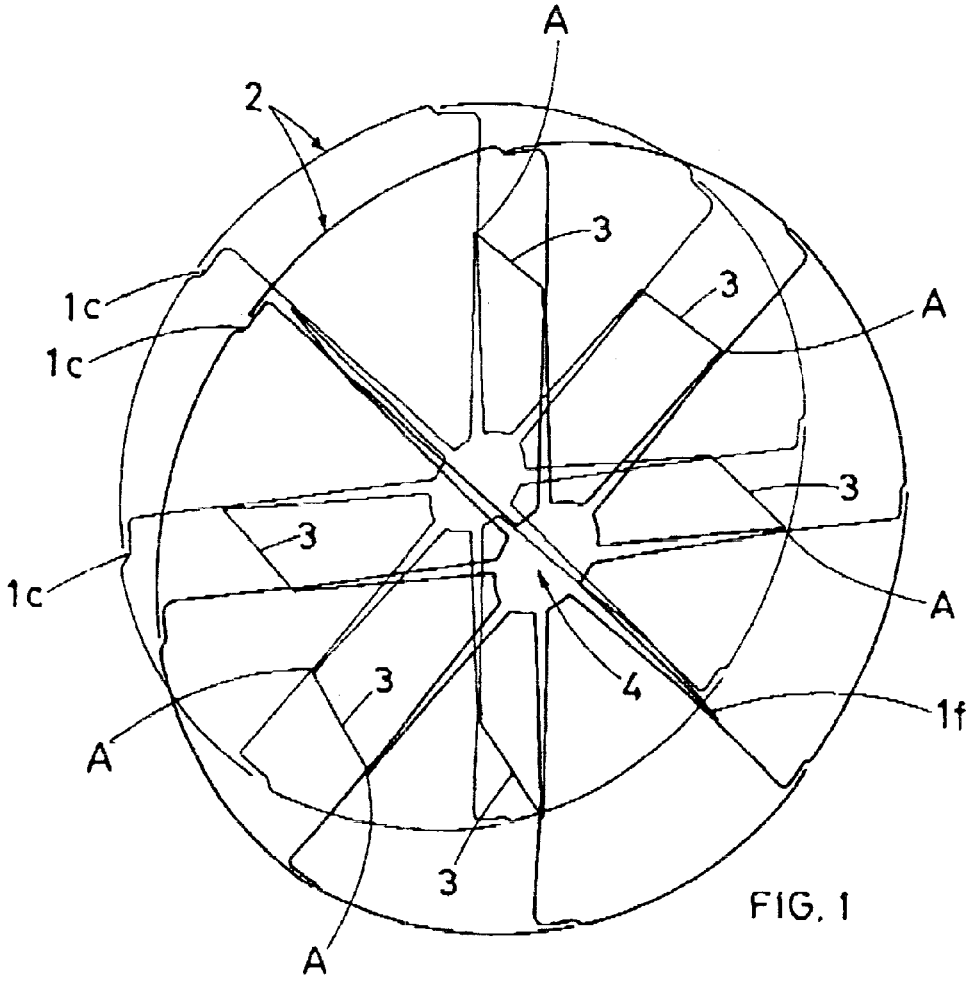
FIG. 1 is an axonometric view of the electrically welded rod iron reel according to the present invention.
Figure 3:
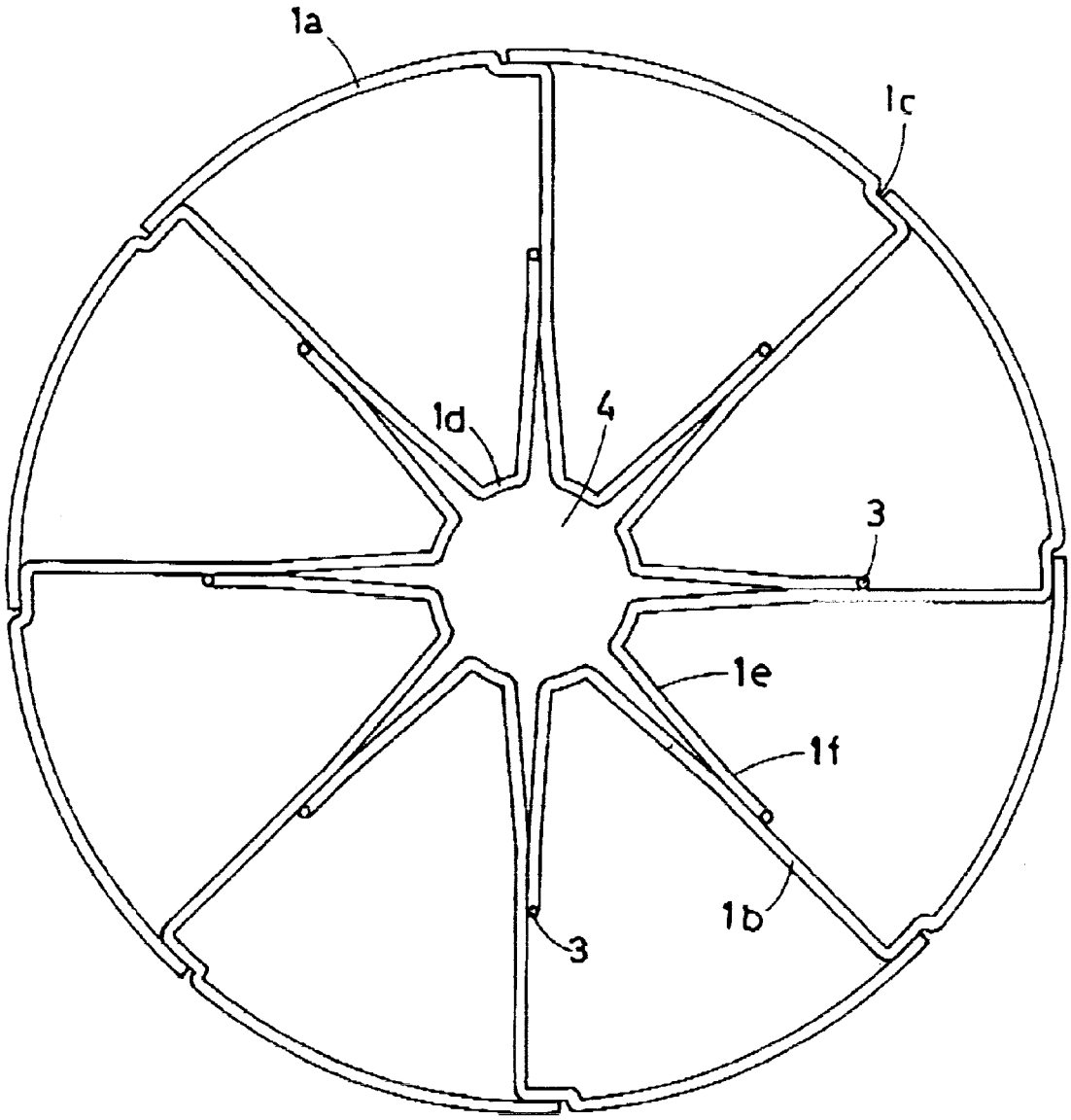
FIG. 3 is a cross-section of the reel according to the present invention with a symmetrical plane perpendicular to the hub axis.

With reference to FIGS. 1 and 3, the reel according to the present invention is composed of an annular series of modular elements (1) made of pre-bent rod iron that, once assembled, generate two opposite identical circular grids (2) connected by an annular series of transversal bars (3) forming a cylindrical cage used to wind the skein of yarn contained between the two opposite grids. Once the modular rod iron elements have been welded one after the other, they generate a reel with central hub (4) that can be directly coupled to the shaft of the machines used to automatically wind or unwind skeins of yarn.

Figure 2:
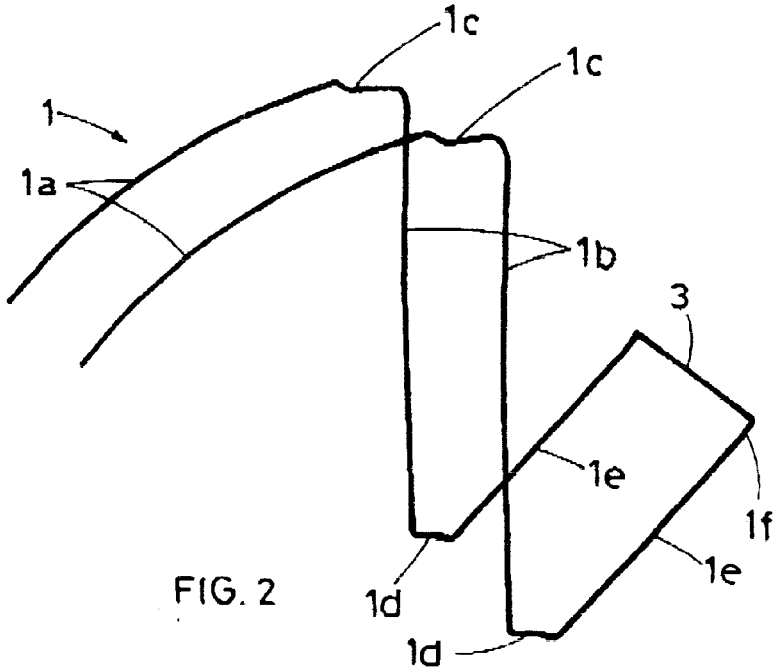
FIG. 2 is an axonometric view of one of the bent rod iron modular elements forming the metal reel according to the present invention.

With particular reference to FIG. 2, each modular element (1) is realized from a single rod iron piece that is especially bent in order to obtain a special three-dimensional profile featuring:

- a first parallel pair of identical long arches **(1*a*) located a distance equal to the distance between the two circular grids (2)** of the reel;
- a first parallel pair of identical radial arms **(1*b*) directed towards the centre of the reel and connected to the two arches (1*a*) by means of a step (1*c*)**;
- a second parallel pair of identical short arches **(1*d*), concentric with respect to the peripheral arches (1*a*) and facing the opposite direction with respect to the radial arms (1*b*)**;
- a second parallel pair of identical radial arms **(1*e*) directed towards the periphery of the reel and shorter than the arms (1*b*)**;
- a transversal bar (3) connecting the ends of the second pair of radial arms **(1*e*) and having the same length as the distance between the two circular grids (2)** of the reel.

As already mentioned, the reel according to the present invention is produced by electro-welding various modular elements (1) one after the other one. In this way, the free ends of the peripheral arches **(1*a*) overlap the connection step (1*c*) of the adjacent module, and all the peripheral arches (1) generate the parallel pair of identical circles that practically coincide with the external edges of the pair of circular grids (2)**.

All the short arches **(1*d*) generate a second parallel pair of identical circles that practically coincide with the edges of the reel hub (4)**.

The modular elements (1) are permanently held together by means of electro-welding in all the connection steps **(1*c*)**

and in the points (A) in which the transversal bar (3) of each module (1) touches the pair of radial arms (1*b*) of the adjacent module (1).

Figure 4:
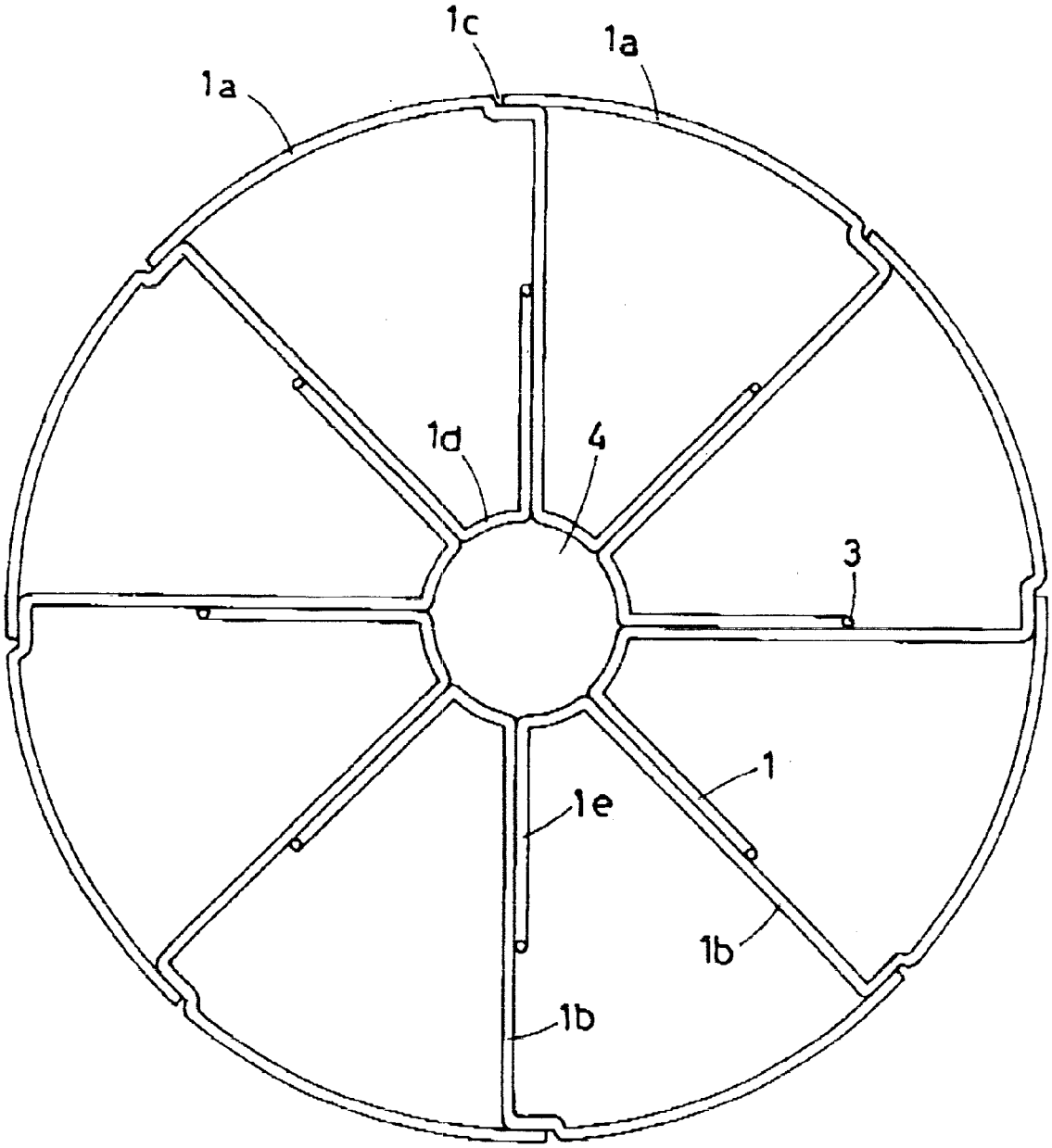
FIG. 4 is the same as FIG. 3, but refers to an alternative version of the reel according to the present invention, which slightly differs from the first version.

The constructive version of the reel shown in FIG. 4 differs from the previous one in a simple constructive detail due to the different tilting of the radial arms (1*b* and 1*e*) that causes the arms (1*e*) of the first module (1) to touch the arms (1*b*) of the second adjacent module (1) in their entire length.

In the version shown in FIG. 3, the tilting of the radial arms (1*b* and 1*e*) causes the arms (1*e*) of the first module (1) to touch the arms (1*b*) of the second adjacent module (1) only in their final section (1*f*) (i.e. the modules which are the last ones which are connected to one another in forming the reel).

What is claimed is:

1. Yarn-winding metal reel which comprises an annular series of electrically welded modular elements (1), with each element (1) composed of a single rod having a plurality of bends therein featuring:

a first parallel pair of identical long arches (1*a*), each long arch having a free end;

a first parallel pair of identical radial arms (1*b*) directed towards a center hub (4) of the reel and connected to the two arches (1*a*) by means of a connection step (1*c*);

a second parallel pair of identical short arches (1*d*), concentric with respect to a peripheral first parallel pair of identical long arches (1*a*) and facing an opposite direction from the long arches with respect to the parallel pair of identical radial arms (1*b*);

a second parallel pair of identical radial arms (1*e*) directed towards the periphery of the reel and shorter than the first parallel pair of identical radial arms (1*b*) and terminating in respective ends;

a transversal bar (3) connecting the respective ends of the second pair of identical radial arms (1*e*), the modular elements (1) being disposed adjacent to one another forming the reel such that the transversal bar (3) of each modular element (1) contacts an intermediate section of the first parallel pair of identical radial arms (1*b*) of the adjacent modular elements, being electrically welded thereto, and such that the free ends of the first parallel pair of identical long arches (1*a*) of each modular element (1) contact the connection steps (1*c*) of the adjacent modular element on the periphery of the reel, being electrically welded thereto wherein each modular element is connected to each adjacent modular element by two welds.

2. Reel according to claim 1 characterized by the fact that the tilting of the first (1*b*) and second (1*e*) parallel pairs of identical radial arms causes the second parallel pairs of identical radial arms (1*e*) of the first modular element (1) to touch the first parallel pair of identical radial arms (1*b*) of the second adjacent modular element (1) only in a final section (1*f*) of the second parallel pairs of identical radial arms (1*e*).

3. Reel according to claim 1 characterized by the fact that the tilting of the first (1*b*) and second (1*e*) parallel pairs of identical radial arms causes the second parallel pairs of identical radial arms (1*e*) of the first modular element (1) to touch the first parallel pair of identical radial arms (1*b*) of the second adjacent modular element (1) in the entire length of the second parallel pairs of identical radial arms (1*e*).

* * * * *